US005500961A

United States Patent [19]

Tsai

[11] Patent Number: 5,500,961

[45] Date of Patent: Mar. 26, 1996

[54] DOUBLE-TRIP HANDLE TYPE FLUSH CONTROL MECHANISM FOR BALLFLOAT TOILETS

[76] Inventor: Jin-Bo Tsai, No. 23, Lane 12, Chien Tung Street, Tainan City, Taiwan

[21] Appl. No.: 395,956

[22] Filed: Feb. 28, 1995

[51] Int. Cl.[6] ..... E03D 1/14

[52] U.S. Cl. ..... 4/325; 4/405

[58] Field of Search ..... 4/324, 325, 326, 4/405

[56] References Cited

U.S. PATENT DOCUMENTS 3,823,425 7/1974 Coffman ..... 4/325 X
4,305,163 12/1981 Raz ..... 4/325
5,075,907 12/1991 Harris ..... 4/325
5,375,268 12/1994 Chen ..... 4/325
5,400,445 3/1995 Hull ..... 4/325

*Primary Examiner*—Robert M. Fetsuga
*Attorney, Agent, or Firm*—Pro-Techtor International

[57] ABSTRACT

A flush control mechanism including a first trip handle turned to lift the tank ball of the water tank of a ballfloat toilet for allowing the full volume of water to be drawn out of the water tank, a second trip handle turned to lift the tank ball for allowing a half volume of water to be drawn out of the water tank, a float ball assembly controlled by a swivel block and the second trip handle to force down the tank ball when a predetermined volume of water is drawn out of the water tank after the second trip handle is operated.

2 Claims, 11 Drawing Sheets

DOUBLE-TRIP HANDLE TYPE FLUSH CONTROL MECHANISM FOR BALLFLOAT TOILETS

BACKGROUND OF THE INVENTION

The present invention relates to flush control mechanism for ballfloat toilets, and relates more particularly to a double-trip handle type flush control mechanism which has two trip handles operated to let different volumes of water be drawn out of the water tank.

Ballfloat toilets are commonly used in families and public washrooms for carrying waste matter away from the body. A regular ballfloat toilet is generally comprised of a bowl and a water tank mounted on the back side of the bowl and controlled by a trip handle to let water be drawn through a valve seat into the bowl. When the trip handle is operated, about 6–9 liters of water (depends on the size of the water tank) is drawn away from the water tank. This big volume of water is sufficient to flush waste matter away from the bowl. However, because same volume of water is drawn away from the water each time the trip handle is operated, much water is wasted when when to flush urine away from the bowl.

SUMMARY OF THE INVENTION

The present invention has been accomplished to provide a double-trip handle type flush control mechanism for ball-flot toilets which eliminates the aforesaid problem. According to the present invention, the flush control mechanism comprises a first trip handle turned to lift the tank ball of the water tank of a ballfloat toilet for allowing the full volume of water to be drawn out of the water tank, a second trip handle turned to lift the tank ball for allowing a half volume of water to be drawn out of the water tank, a float ball assembly controlled by a swivel block and the second trip handle to force down the tank ball when a predetermined volume of water is drawn out of the water tank after the second trip handle is operated.

DETAILED DESCRIPTION OF THE PREFERRED EMBODIMENTS

Figure 1:
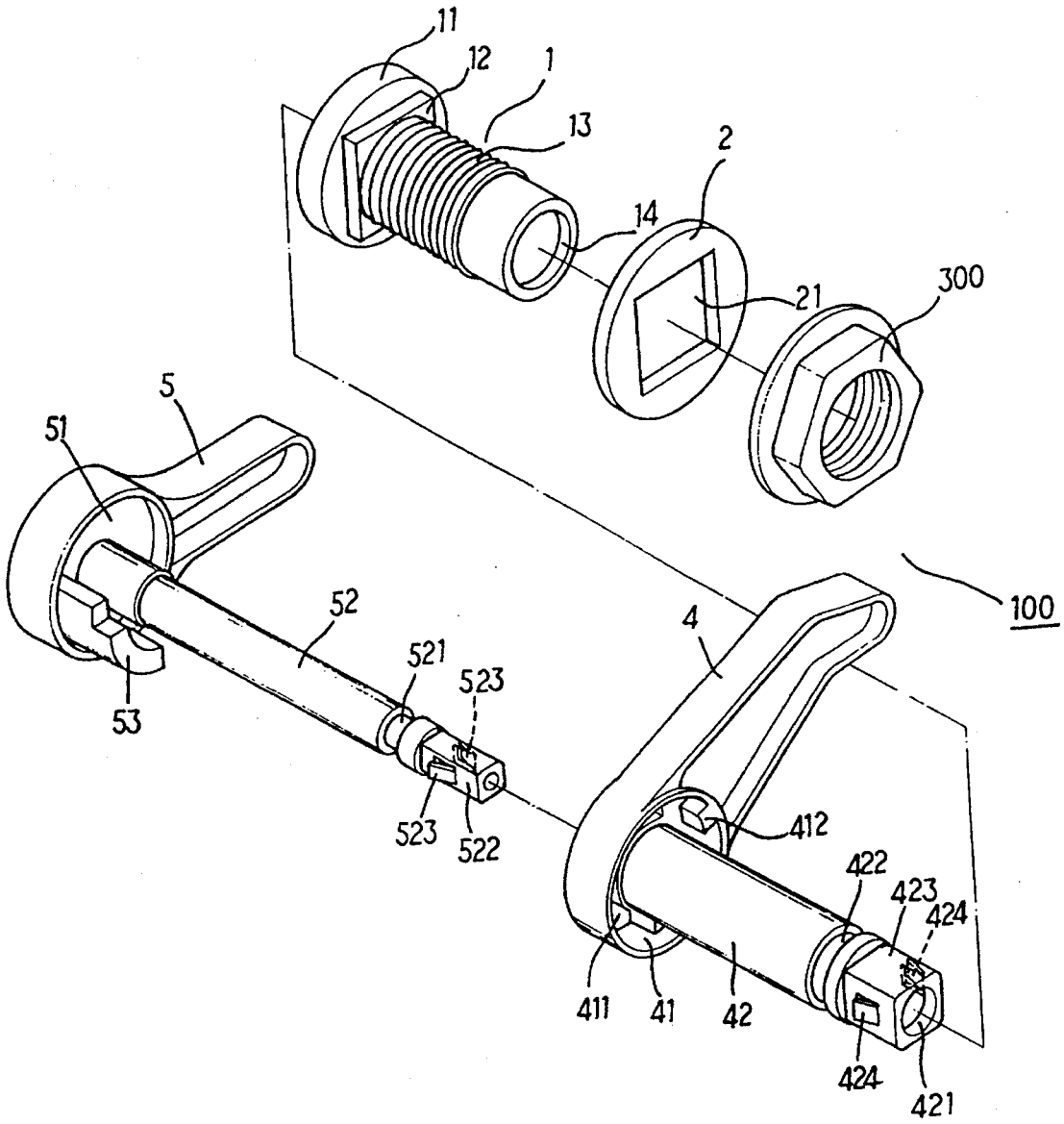
FIG. 1 is an exploded view of a trip handle unit according to the present invention.
Figure 2:
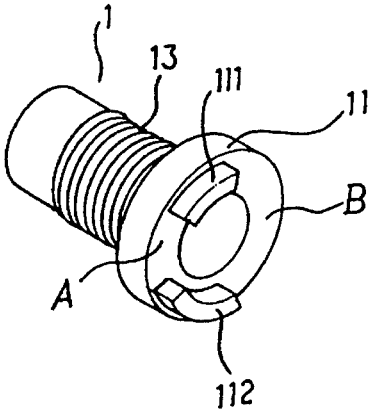
FIG. 2 is an elevational view of the barrel shown in FIG. 1, showing the positions of the first and second moving zones.
Figure 3:
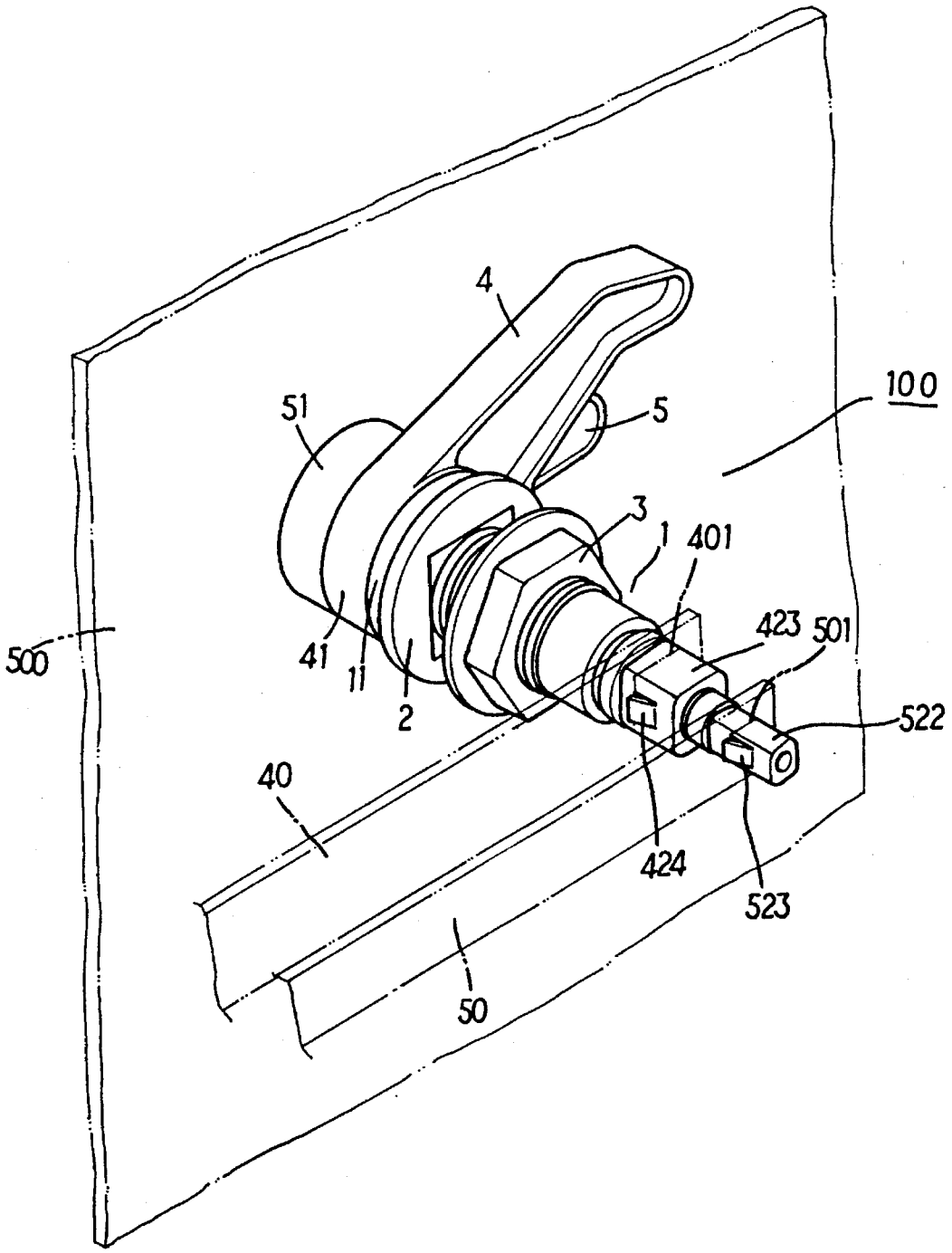
FIG. 3 shows the trip handle unit of the present invention installed in the water tank.
Figure 4:
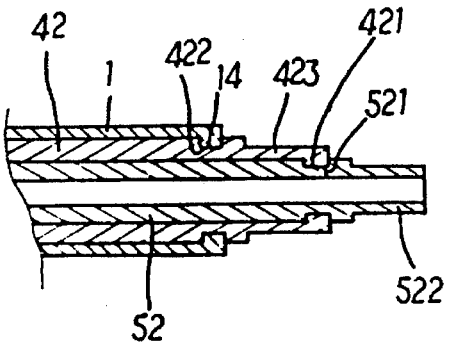
FIG. 4 is a partial view in section of the trip handle unit according to the present invention.
Figure 5:
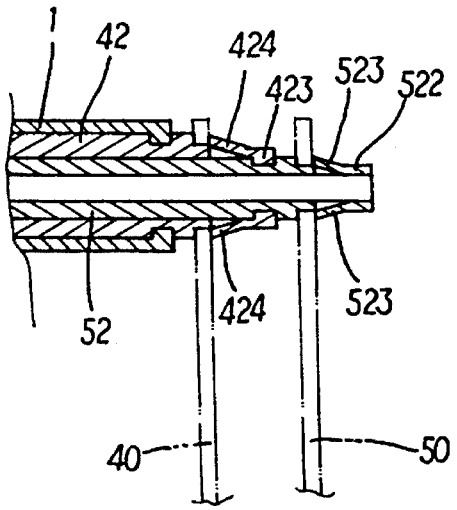
FIG. 5 is similar to FIG. 4 but showing the first and second links respectively fastened to the first and second trip handles.
Figure 6:
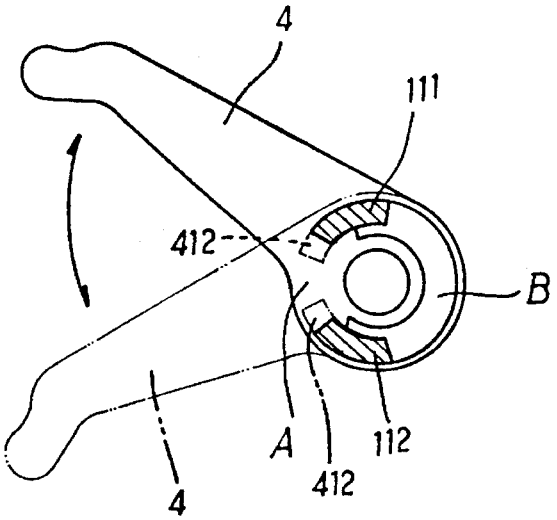
FIG. 6 shows the turning angle of the first trip handle according to the present invention.
Figure 7:
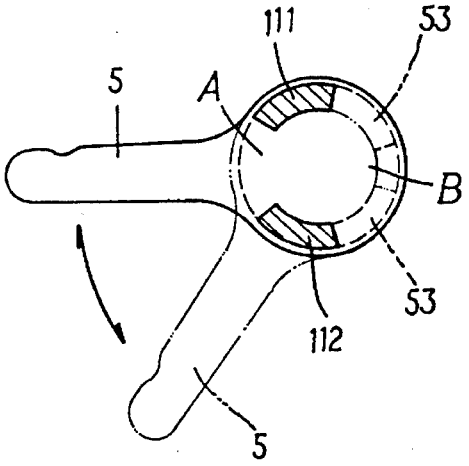
FIG. 7 shows the turning angle of the second trip handle according to the present invention.
Figure 8:
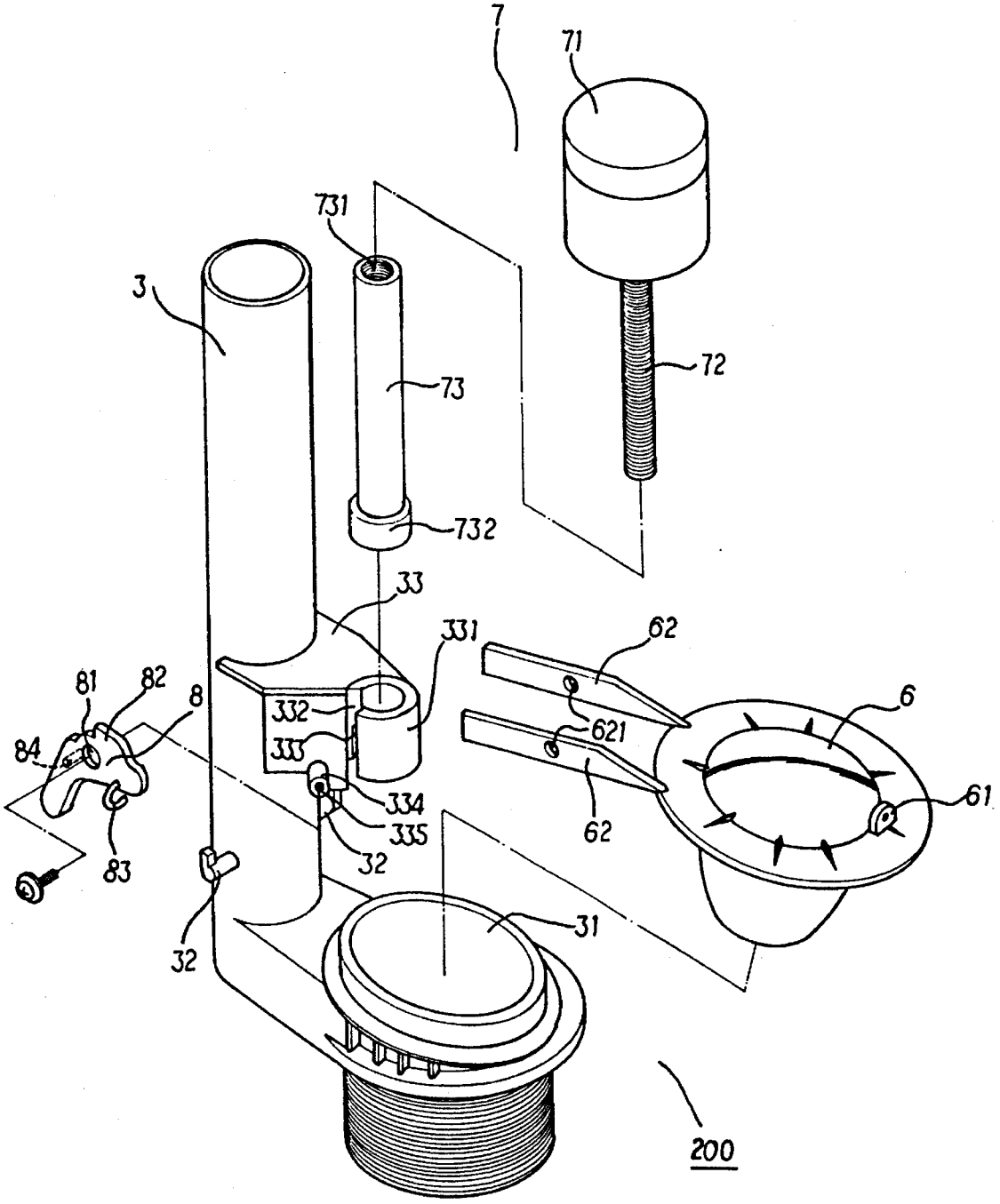
FIG. 8 is an exploded view of a flushing unit according to the present invention.

Referring to FIGS. from 1 to 15, a double-trip handle type flush control mechanism according to the present invention is generally comprised of a trip handle unit 100 (see FIGS. 1 and 3), and a flushing unit 200 (see FIG. 8). The trip handle unit 100 comprises a barrel 1, a water sealing cushion 2, a nut 300, a first trip handle 4, a second trip handle 5, a first link 40, and a second link 50. The barrel 1 comprises a circular outside flange 11 raised from the outside wall thereof at one end, an inside annular flange 14 raised from the inside wall thereof at an opposite end, a threaded portion 13 around the periphery, a square block 12 raised from the inner side of the circular outside flange 11, a first locating block 111 and a second locating block 112 raised from the outer side of the circular outside flange 11 opposite to the square block 12 and defining a first moving zone A and a second moving zone B. The water sealing cushion 2 defines a square center hole 21 into which the square block 12 fits. When the operating knob unit 100 is installed in a trip handle mounting hole (not shown) on the water tank 500 of a ballfloat toilet, the water sealing cushion 2 seals up the gap between the water tank 500 and the barrel 1. The nut 300 is threaded onto the threaded portion 13 of the barrel 1 to fasten the barrel 1 to the peripheral wall of the water tank 500. The first trip handle 4 comprises a cap-like circular shell 41 at one end defining a curved slot 411, a tubular shaft 42 perpendicularly extended from the center of the circular shell 41, a locating block 412 raised from the inside surface of the circular shell 41. The tubular shaft 42 of the first trip handle 4 comprises a square coupling portion 423 at the end remote from the circular shell 41, an inside annular flange 421 raised from the inside wall of the square coupling portion 423, an outside annular groove 422, and two retainer springs 424 made on two opposite sides of the square coupling portion 423. When the tubular shaft 42 is inserted through the barrel 1, the inside annular flange 14 of the barrel 1 is engaged with the outside annular groove 422 of the tubular shaft 42 (see FIG. 4), the locating block 412 is inserted into the first moving zone A for allowing the tubular shaft 42 to be turned within the inside annular flange 14 and stopped between the first locating block 111 and second locating block 112 of the barrel 1, and therefore the turning angle of the tubular shaft 42 (the first trip handle 4) is limited (see FIG. 6). The second trip handle 5 comprises a cap-like circular shell 51 at one end, a stem 52 perpendicularly extended from the center of the circular shell 51, a locating block 53 perpendicularly extended from the cap-like shell 51 and disposed in parallel with the stem 52. The stem 52 of the second trip handle 5 comprises a square coupling portion 522 at the end remote from the circular shell 51, an outside annular groove 521 around the periphery near the square coupling portion 522, and two retainer springs 523 raised from two opposite sides of the square coupling portion 522. The stem 52 of the second trip handle 5 is inserted through the tubular shaft 42 of the first trip handle 4, permitting the inside annular flange 421 of the tubular shaft 42 of the second trip handle 4 to be engaged with the outside annular groove 521 of the stem 52. When the stem 52 of the second trip handle 5 is inserted through the tubular shaft 42 of the first trip handle 4 and the inside annular flange 421 of the tubular shaft 42 is engaged with the outside annular groove 521 of the stem 52, the square coupling portion 522 is extended out of the tubular shaft 42 (see FIG. 3), the locating block 53 is inserted into the second moving zone B for allowing the stem 52 to be turned within the inside annular 421 and stopped between the first locating block 111 and second locating block 112 of the barrel 1, and therefore the turning angle of the stem 52 (the second trip handle 5) is limited (see FIG. 7). The first link 40 has a square hole 401 at one end fastened to the square coupling portion 423 of the tubular shaft 42 and stopped in place by the retainer springs 424. When the first link 40 is mounted on the square coupling portion 423 of the tubular shaft 42, the retainer springs 424 are squeezed inwards for allowing the square hole 401 to pass. As soon as the square hole 401 passes over the retainer springs 424 and the first link 40 is moved into position, the retainer springs 424 immediately return to their former shapes to stop the first link 40 in place, and therefore the first link 40 and the tubular shaft 42 of the first trip handle 4 are connected together (see FIGS. 3 and 5). The second link 50 has a square hole 501 at one end fastened to the square coupling portion 523 of the stem 52 and stopped in position by the retainer springs 523 (see FIGS. 3 and 5). The procedure of mounting the second link 50 on the square coupling portion 523 of the stem 52 is similar to that of mounting the first link 40 on the square coupling portion 423 on the tubular shaft 42 of the first trip handle 4.

Figure 9:
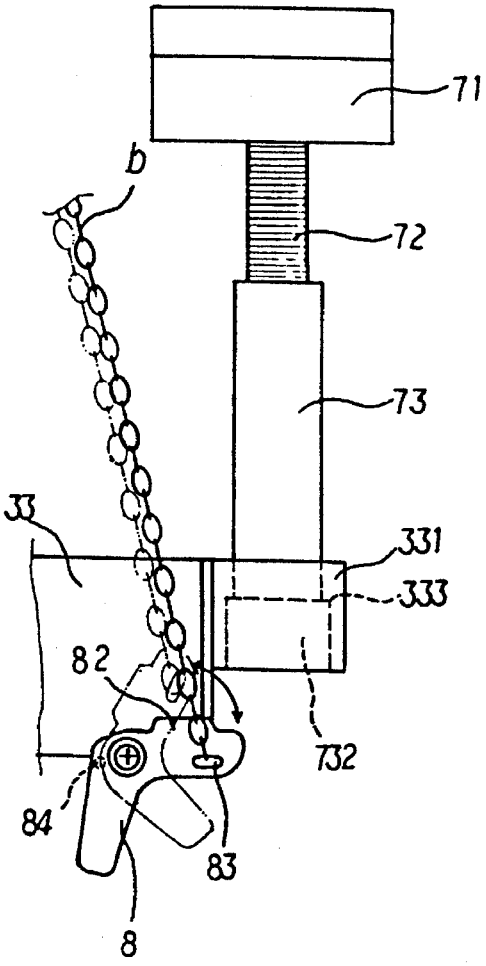
FIG. 9 is a side view showing the float ball assembly disposed at the upper limit position.
Figure 11:
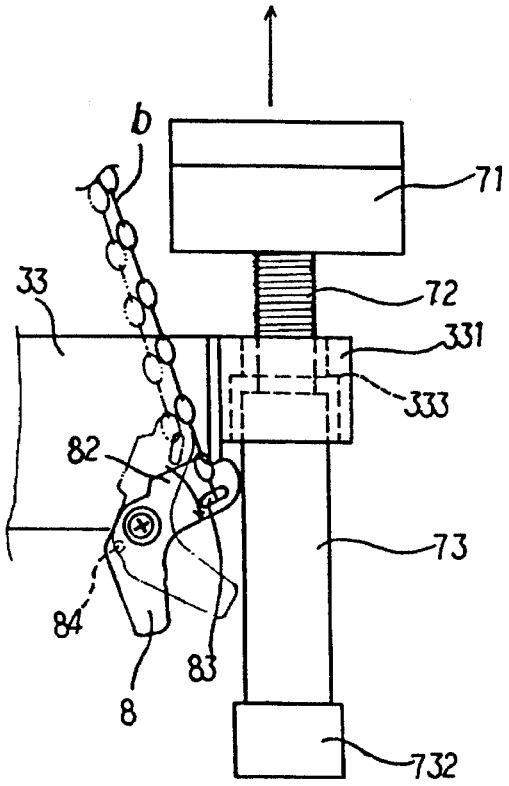
FIG. 11 is similar to FIG. 11 but showing the float ball assembly moved upwards.
Figure 12:
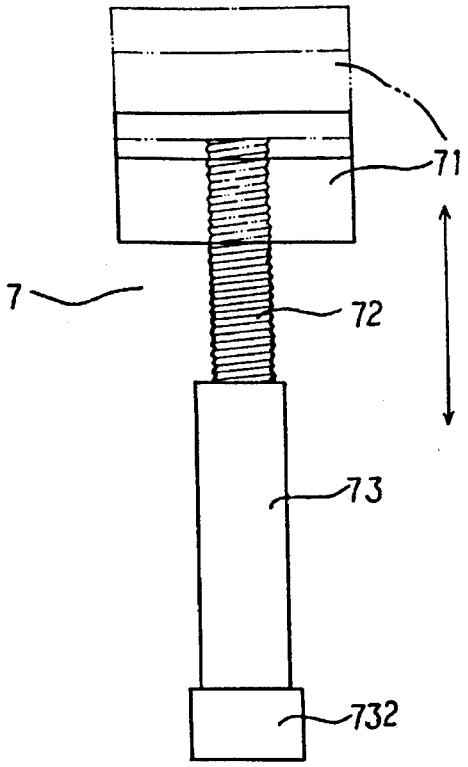
FIG. 12 shows the combined length of the float ball assembly adjusted according to the present invention.

The aforesaid flushing unit 200, as shown in FIG. 8, comprises an overflow tube 3, a tank ball 6, a float ball assembly 7, and a swivel block 8. The overflow tube 3 has a bottom end coupled with a valve seat 31. The tank ball 6 is covered on the valve seat 31. When the tank ball 6 is lifted from the valve seat 3, water immediately flows out of the water tank 500 through the valve seat 3 to flush the bowl (not shown). The overflow tube 3 comprises two opposite mounting rods 32 near the bottom end, a frame 33 raised from the peripheral wall at an elevation above the mounting rods 32, a vertical axle housing 331 made on the frame 33 and having a longitudinal opening 332 through the periphery and a step 333 around the inside wall, and a side rod 334 defining a screw hole 335 (see FIGS. 9, 10, and 11). The tank ball 6 comprises two parallel arms 62 respectively turned about the mounting rods 32 on the overflow tube 3, each arm 62 having a respective pivot hole 621, which receives one mounting rod 32. The tank ball 6 further comprises a lifting eye 61 at the top remote from the arms 61. The lifting eye 62 is connected to the first link 40 and the second link 50 by chains a and chain c respectively (see FIGS. 13 and 14). The float ball assembly 7 comprises a locating tube 73 inserted into the axle housing 331 of the frame 33 of the overflow tube 3 and having an inner thread 731 around the inside wall and a bottom end terminating in an outward flange 732, and a float ball 71 having a bottom screw rod 72 threaded into the inner thread 731 on the locating tube 73 (see FIG. 12). The combined length of the float ball 71 and the locating tube 73, namely, the combined length of the float ball assembly 7 can be adjusted by turning the bottom screw rod 72 in the inner thread 731. When the float ball 71 floats on the water inside the water tank 500, the outward flange 732 is stopped at the step 333 of the axle housing 311 to limit the upper limit position of the float ball 71. The swivel block 8 is turnably fastened to the side rod 334 of the frame 33 of the overflow tube 3 by threading threading a headed screw into the screw hole 335 on the side rod 334, having a center pivot hole 81, which receives the side rod 334, a weight 82 and a hook 83 at one end, and a raised portion 84 at an opposite end. The hook 83 of the swivel block 8 is connected to the second link 50 by a chain b. The connecting point between the second link 50 and the chain b is spaced between the chain c and the second trip handle 5 (see FIGS. 13 and 14). When the chain b is driven by the second link 50 to lift the swivel block 8, the swivel block 8 is turned about the side rod 334 in the counterclockwise direction (see FIG. 9). When the chain b is released, the weight 82 forces the swivel block 8 to turn about the side rod 334 in the clockwise direction to pass through the side opening 332 on the axle housing 331 and then disposed below the axle housing 331 (see FIGS. 10 and 11), causing the raised portion 84 stopped at the bottom side of the frame 33 (see FIG. 15).

Figure 13:
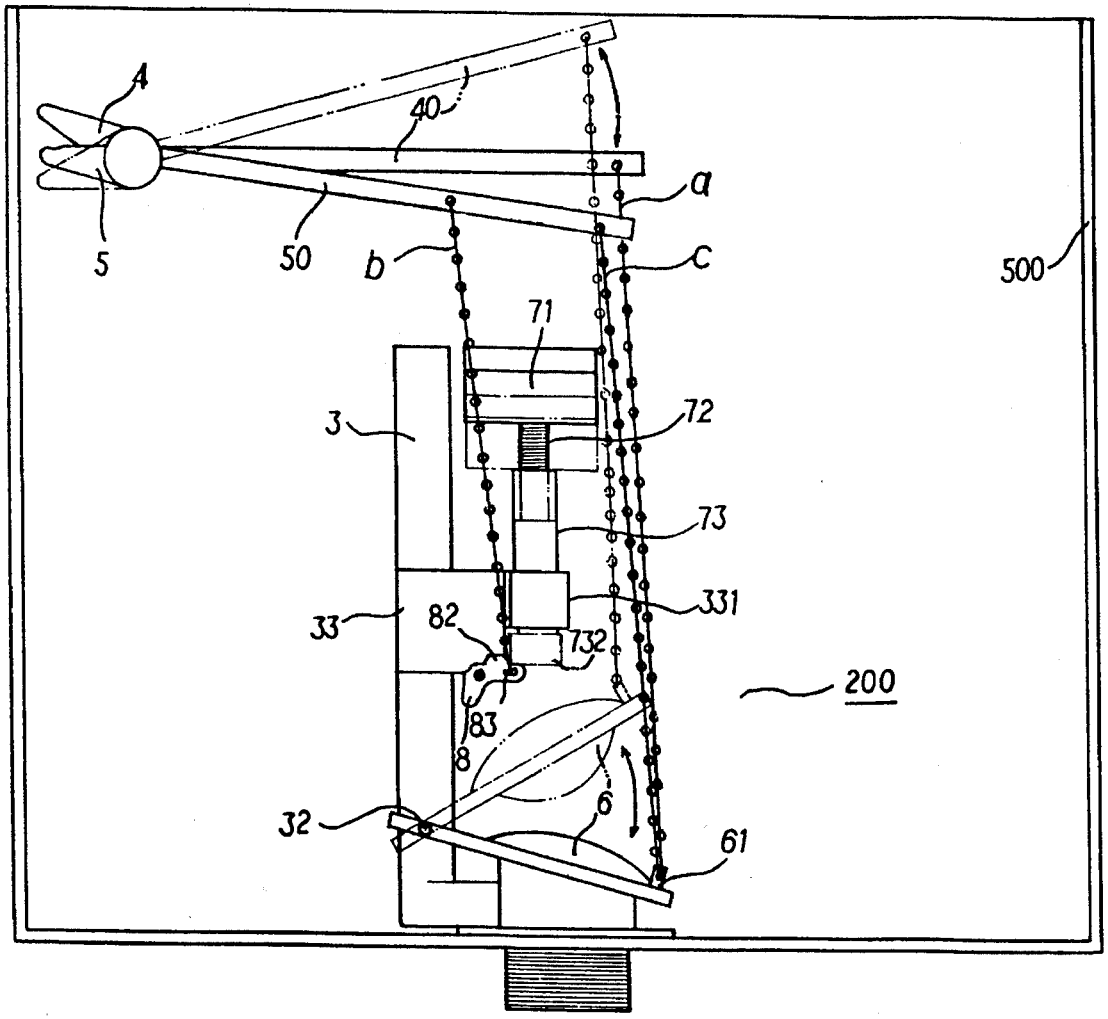
FIG. 13 shows the first trip handle operated according to the present invention.

Referring to FIG. 13, when the first trip handle 4 is pressed down, the link 40 is driven to lift the tank ball 6 from the valve seat 31 by the chain a, causing the full amount of water to be drawn out of the valve seat 31 to flush the bowl, at the same time the float ball assembly 7 is stopped in place by the swivel block 8. When the water level in the water tank 500 drops below the elevation of the valve seat 31, the gravity of the tank ball 6 forces the tank ball to fall down and to close the valve seat 31. When the valve seat 31 is closed by the tank ball 6, water is filled into the water tank 500 to the full water level again.

Figure 10:
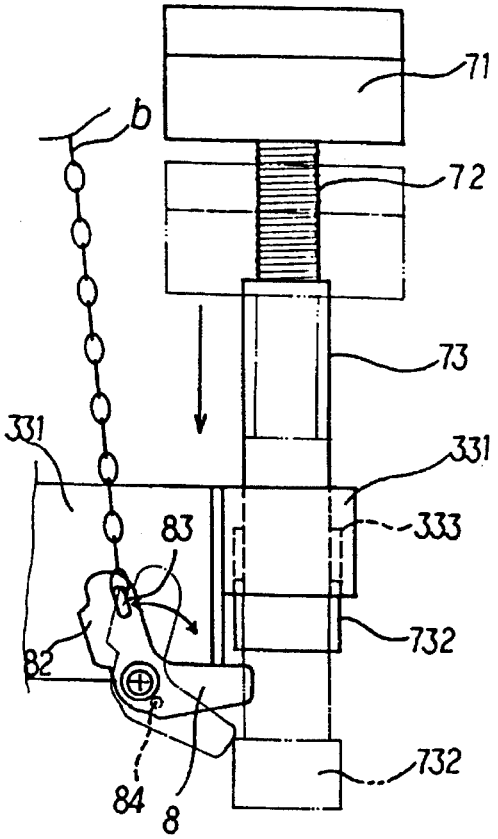
FIG. 10 is similar to FIG. 9 but showing the swivel block lifted and moved away from the float ball assembly and the float ball assembly moved downwards.
Figure 14:
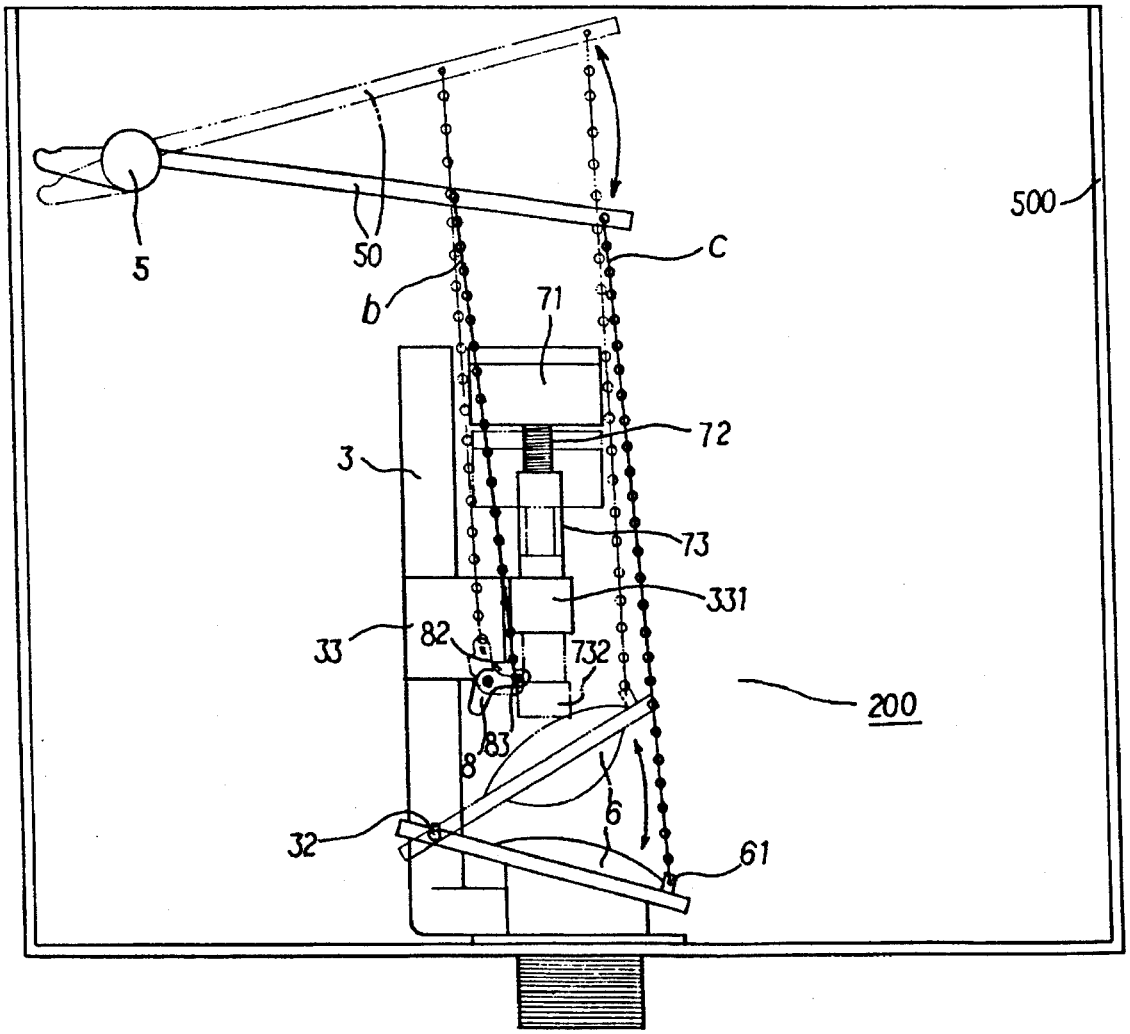
FIG. 14 shows the second trip handle operated according to the present invention.
Figure 15:
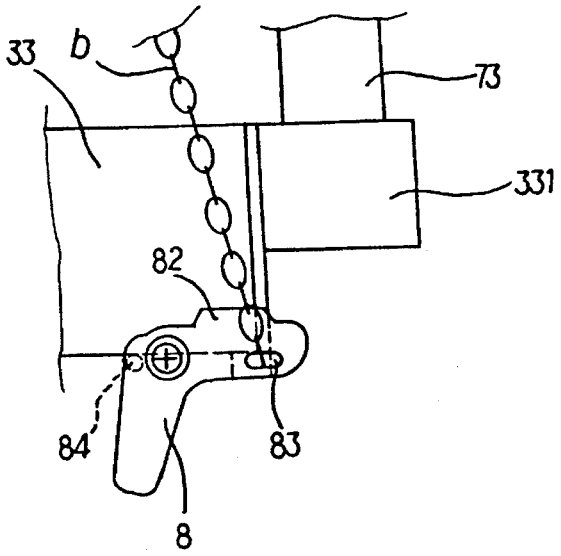
FIG. 15 is a schematic drawing showing the swivel block stopped at the bottom of the frame according to the present invention.

Referring to FIG. 14, when the second trip handle 5 is pressed down, the second link 50 is driven to lift the tank ball 6 and the swivel block 8 through the chain c and the chain b respectively, causing the valve seat 31 opened for letting water be drawn out of the water tank 500 and the swivel block 8 moved away from the float ball assembly 7 (see also FIG. 10. When water continuously flows out of the valve seat 31, the float ball assembly 7 falls with the lowering water level to further press on the tank ball 6, causing the tank ball 6 to close the valve seat 31, therefore only a part of the full volume water is drawn away from the valve seat 31 to flush the bowl. When the valve seat 31 is stopped by the tank ball 6, the second link 50 is pulled downwards by the chain c, causing the second trip handle 5 returned to its former position. When water is continuously filled into the water tank 500 after the valve seat 31 is stopped by the tank ball 6, the float ball assembly 7 is gradually moved by the increasing water level back to its former position (see FIG. 11), and then the swivel block 8 as well as the chain b are moved back to their former positions (see FIG. 9) for a next operation.

Figure 17:
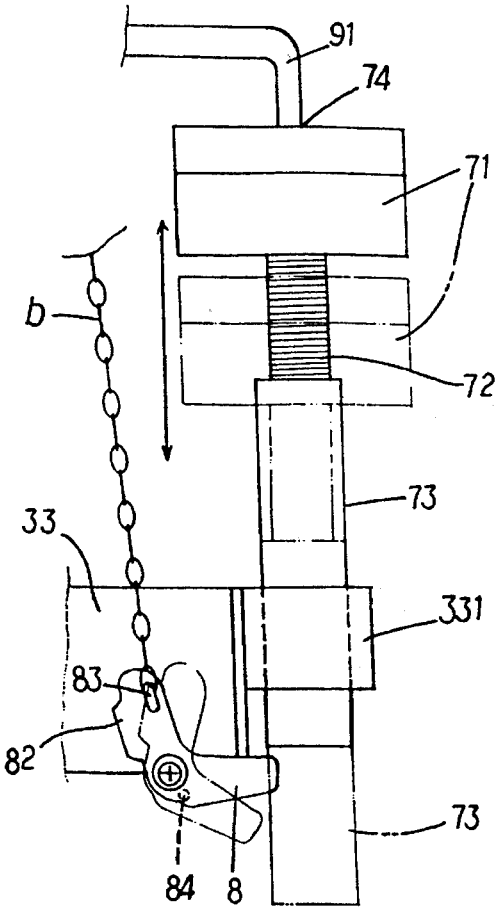
FIG. 17 shows the alternate form of the flushing unit installed and operated according to the present invention.
Figure 16:
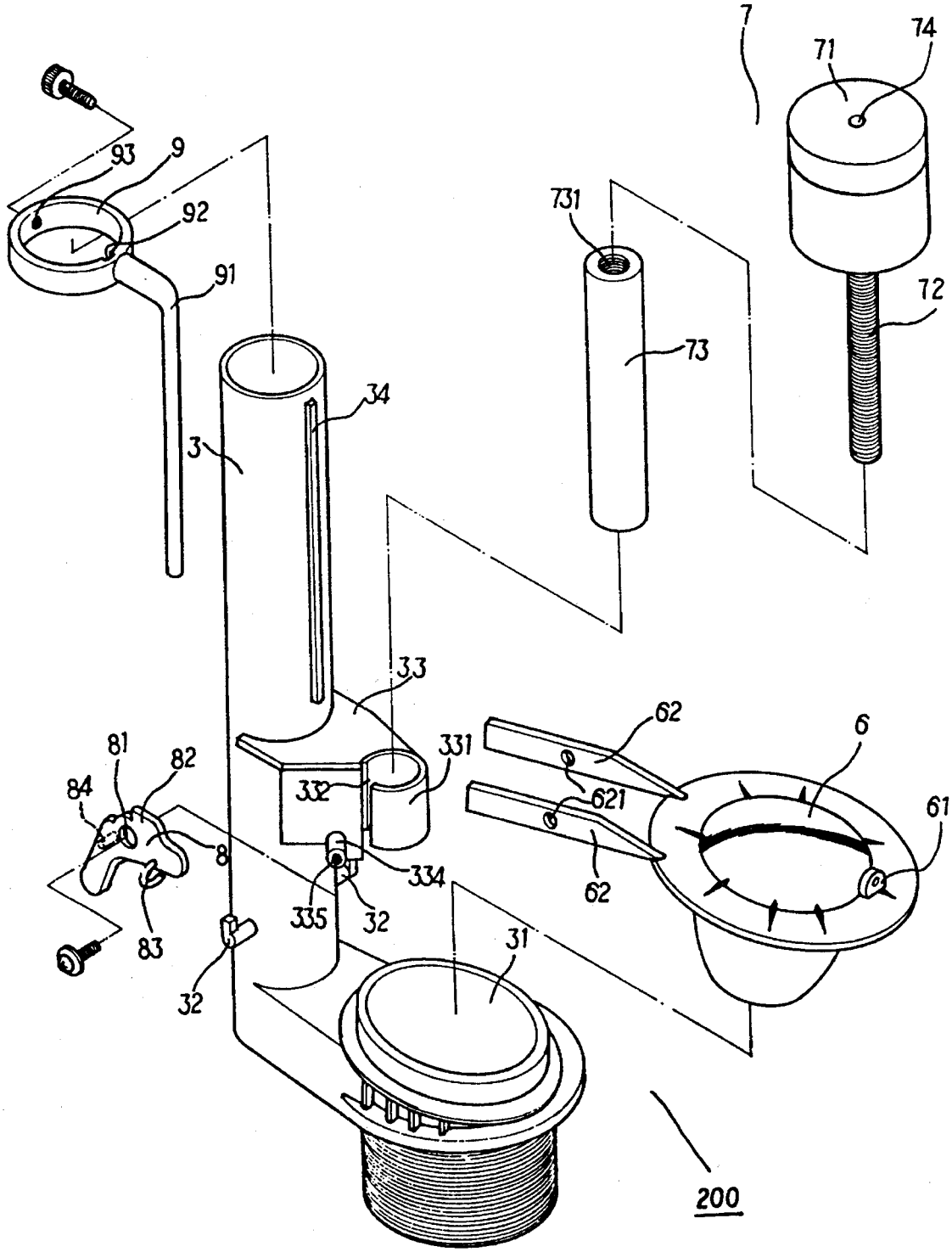
FIG. 16 is an exploded view of an alternate form of the flushing unit according to the present invention.

FIGS. 16 and 17 show an alternate form of the present invention, in which: the overflow tube 3 has a longitudinal rib 34 raised from the outside wall above the frame 33; the float ball 71 has a center through hole 74 through the longitudinal center of the bottom screw rod 72; a locating ring 9 mounted around the overflow tube 3 to guide the movement of the float ball assembly 7. The locating ring 9 has a screw hole 93 into which a tightening up screw is threaded and stopped against the outside wall of the overflow tube 3 to fix the locating ring 9 to the overflow tube 3 at the desired elevation, an inside vertical groove 92 engaged with the longitudinal rib 34 of the overflow tube 3, and a guide rod 91 extended from the periphery and inserted into the center through hole 74 on the float ball assembly 7. The operation of this alternate form is similar to the aforesaid operation procedure.

As indicated above, the double-trip handle type flush control mechanism of the present invention achieves numerous advantages including:

1) Because the locating blocks 412 and 53 are respectively confined to move in the first moving zone A and the second moving zone B between the first locating block 111 and the second locating block 112, the movement of the first trip handle 4 and the movement of the second trip handle 5 neither strike the tank lid of the water tank 500 nor break the chains, and therefore the service life of the toilet is prolonged;

2) Because the first link 40 and the second link 50 are respectively stopped in place by the retainer springs 424 and 523, the first link 40 and the second link 50 do not disconnect from the first trip handle 4 and the second trip handle 5 respectively, however the first link 40 and the second link 50 can be conveniently removed from the first trip handle 4 and the second trip handle 5 for a repair or maintenance work;

3) The arrangement of the second trip handle 5 permits the user to open the tank ball 6 from the valve seat 31 for allowing a relatively smaller volume of water (relative to the full volume of water of the water tank 500) to be drawn away from the water tank 500 to flush urine from the bowl so as to save water; and 4) Because the bottom screw rod 72 of the float ball 71 is threaded into the inner thread 731 of the locating tube 73, the combined length of the float ball assembly 7 can be conveniently adjusted to regulate the flushing volume of water controlled by the second trip handle 5.

It is to be understood that the drawings are for the purposes of illustration only, and are not intended as limitations of the definition and scope of the invention disclosed.

What is claimed is:

1. A double-trip handle type flush control mechanism mountable in a water tank of a toilet and controlled to lift a tank ball of the water tank for letting water be drawn out of the water tank to flush the toilet, the water tank including an overflow tube, the mechanism comprising:

a barrel mountable in a trip handle mounting hole on the peripheral wall of the water tank of the ballfloat toilet, said barrel comprising a circular outside flange at one end positionable outside the water tank, an inside annular flange at an opposite end, a threaded portion around the periphery, a square block raised from said circular outside flange, a first locating block and a second locating block raised from said circular outside flange opposite to said square block and defining a first moving zone and a second moving zone;

a water sealing cushion mounted around said square block of said barrel and positionable between said circular outside flange of said barrel and the outside of said water tank;

a nut threaded onto said threaded portion of said barrel and engagable against the inside wall of the water tank to tightly fasten said barrel to said water tank;

a first trip handle mounted on said barrel for lifting said tank ball, said first trip handle comprising a cap-like circular shell at one end disposable outside the water tank and defining a curved slot, a tubular shaft inserted through said barrel, and a locating block raised from the circular shell of said first trip handle and inserted into said first moving zone, the tubular shaft of said first trip handle comprising a square coupling portion at the end remote from the circular shell of said first trip handle, an inside annular flange, an outside annular groove engaged with the inside annular flange of said barrel, and two retainer springs mounted on two opposite sides of the square coupling portion of said first trip handle;

a second trip handle mounted on said first trip handle for lifting said tank ball, said second trip handle comprising a cap-like circular shell at one end disposable outside the water tank, a stem inserted through said tubular shaft of said first trip handle, and a locating block disposed in parallel with said stem and inserted into said second moving zone, said stem comprising a square coupling portion at the end remote from the circular shell of said second trip handle, an outside annular groove engaged with the inside annular flange of the square coupling portion of said first trip handle, and two retainer springs raised from two opposite sides of the square coupling portion of said second trip handle;

a first link having one end mounted around the square coupling portion of said first trip handle and stopped in place by the retainer springs of said first trip handle and turned by said first trip handle, and an opposite end connectable to said tank ball for allowing said tank ball to be lifted by said first trip handle;

a second link having one end mounted around the square coupling portion of said second trip handle and stopped in place by the retainer springs of said second trip handle and turned by said second trip handle, and an opposite end connectable to said tank ball for allowing said tank ball to be lifted by said second trip handle;

a frame securely fixable to the overflow tube of the water tank, having a vertical axle housing and a side rod, said vertical axle housing having a longitudinal opening through a peripheral wall thereof and a step on the inside;

a float ball assembly mounted in said vertical axle housing above said tank ball, said float ball assembly comprising a locating tube inserted into said axle housing and having an inner thread around the inside wall, and a float ball having a bottom screw rod threaded into the inner thread of said locating tube; and a swivel block pivoted about the side rod of said frame, having a weight and a hook at one end, and a raised portion at an opposite end, the hook of said swivel block being connected to said second link by a chain, the raised portion of said swivel block being positioned beneath said axle housing to stop said locating tube of said float ball assembly from falling downward when said tank ball is lifted from said valve seat by said first trip handle; and wherein when said second trip handle is pressed down, the second link is driven to lift said tank ball and said swivel block, causing water to be drawn out of the water tank and said swivel block to move away from said float ball assembly for allowing said float ball assembly to fall and to force down said tank ball so that said tank ball is forced to close when a small volume of water is drawn away from the water tank.

2. The double-trip handle type flush control mechanism of claim 1 further comprises a locating ring mountable around the overflow tube to guide the movement of said float ball assembly, said locating ring comprises a screw hole into which a tightening up screw is threaded and engagable against the overflow tube to fix said locating ring to the overflow tube at the desired elevation, an inside vertical groove engaged with a longitudinal rib mountable on the overflow tube, and a guide rod extended from the periphery and inserted into a center through hole in said float ball and its bottom screw rod.

* * * * *